US007295434B2

(12) United States Patent
Foulonneau

(10) Patent No.: US 7,295,434 B2
(45) Date of Patent: Nov. 13, 2007

(54) ELECTRONICALLY CONTROLLED ELECTRIC FAN COOLED BY PRESSURIZED AMBIENT AIR

(75) Inventor: Stephane Foulonneau, Pontvallain (FR)

(73) Assignee: Siemens VDO Automotive, Toulouse (FR)

( * ) Notice: Subject to any disclaimer, the term of this patent is extended or adjusted under 35 U.S.C. 154(b) by 208 days.

(21) Appl. No.: 11/152,096

(22) Filed: Jun. 15, 2005

(65) Prior Publication Data

US 2006/0024170 A1 Feb. 2, 2006

(30) Foreign Application Priority Data

Jun. 15, 2004 (FR) ..... 04 06480

(51) Int. Cl.
*H05K 7/20* (2006.01)

(52) U.S. Cl. ..... 361/695; 361/691

(58) Field of Classification Search ..... 361/695, 361/690, 691, 692; 417/47
See application file for complete search history.

(56) References Cited

U.S. PATENT DOCUMENTS 5,091,823 A * 2/1992 Kanbara et al. ..... 361/697
5,276,584 A * 1/1994 Collins et al. ..... 361/718
5,457,605 A * 10/1995 Wagner et al. ..... 361/720
5,801,632 A * 9/1998 Opal ..... 340/585
5,831,830 A * 11/1998 Mahler ..... 361/704
5,925,948 A 7/1999 Matsumoto ..... 310/67 R
5,946,192 A * 8/1999 Ishigami et al. ..... 361/704
6,101,090 A * 8/2000 Gates ..... 361/690
6,278,207 B1 8/2001 Matsumoto ..... 310/88
6,813,149 B2 * 11/2004 Faneuf et al. ..... 361/687
6,847,524 B2 * 1/2005 Tomioka et al. ..... 361/695
7,027,300 B2 * 4/2006 Lord ..... 361/695

FOREIGN PATENT DOCUMENTS

DE 202 12 170 12/2002
WO WO 03/075433 9/2003

* cited by examiner

*Primary Examiner*—Hae Moon Hyeon
(74) *Attorney, Agent, or Firm*—Young & Thompson

(57) ABSTRACT

An electronically controlled electric fan (10) cooled by pressurized ambient air, includes:

a motor (11) furnished with a cover (12), a mechanical assembly rotating a wheel (15) and a casing (13), the motor housing at least its electronic control circuit (14) and includes at least one inlet orifice (I) and one outlet orifice (S) for the pressurized ambient air, a fan wheel (15) and a mechanical assembly rotating this wheel, a motor support (16), the ambient air being suitable for passing through the motor, and its mechanical assembly and the support, the electric fan including:

a confinement element (20) placed inside the motor so as to confine the pressurized ambient air between:

a heat sink (18) integral with the electronic control circuit (14), and a portion of the motor including no sensitive electronic components.

9 Claims, 1 Drawing Sheet

ELECTRONICALLY CONTROLLED ELECTRIC FAN COOLED BY PRESSURIZED AMBIENT AIR

The present invention relates to an electronically controlled electric fan cooled by pressurized ambient air. More particularly it involves cooling with the aid of pressurized ambient air the electronic control of an air conditioning motor.

BACKGROUND OF THE INVENTION

Motor vehicles are increasingly fitted with electric fans providing their air conditioning. These electric fans comprise in particular a motor driving a wheel associated with a cooling means.

These electric fans are controlled by a control device supported by an electronic circuit board implemented on a printed circuit. When the motor is operating, the electronic circuit board is acted upon and the printed circuit gives off heat.

To discharge this heat, it is already known practice to use the air flow passing through the wheel (providing the ventilation) to cool the printed circuit board. So doing, this air flow enters into contact not only with the radiator (usually made of aluminum) of the control device but also with the various electronic components present on the printed circuit. Such cooling is usually satisfactory, but when the ambient air blown over the printed circuit is polluted, the electric connections of the various components, even the components themselves, risk being damaged by the polluted air.

Thus in a salty environment (a saline maritime atmosphere) and/or an environment polluted by particles of mud, dust, snow, ice, etc, these particles are found on the printed circuit board and damage the components and/or their connections.

DESCRIPTION OF THE PRIOR ART

It is already known practice to filter the air required to cool the printed circuit, but in addition to the fact that the filtered air circulates less well (due to the loss of pressure caused by the presence of the filter), this solution has the disadvantage of requiring the installation of a filter and its maintenance (the aim of which is to prevent it clogging). The maintenance of the filter is in fact rarely carried out and the performance of the whole system is thereby rapidly diminished.

It is also already known practice to cover the components of the circuit that are to be subjected to the polluted air with varnish or polyurethane resin. Such solutions however have the known disadvantage of preventing (or of making more difficult) any subsequent repair of the printed circuit because, to gain access to the components, the varnish or the resin has to be removed. This operation of cleaning the printed circuit before repair is extremely difficult to achieve without damaging the components. Due to this, the solutions that consist in covering the electronic components with protective materials cannot be used when it is required to be able to easily repair the printed circuit, although the recycling or the repair of the printed circuit board is not the primary aim. Note also that a printed circuit board covered with certain resins is not recyclable.

To alleviate these disadvantages, it is also known practice to produce thin varnishes, but in this case their resistance to an aggressive environment is diminished.

SUMMARY OF THE INVENTION

The purpose of the present invention is therefore to create an electronically controlled electric fan cooled by pressurized ambient air, without risk of pollution and damage of the electronic components present on the control circuit, while allowing access to these electronic components for their repair and without requiring the use of filters that are susceptible to clogging.

Another object of the invention is to produce such an electric fan in a low cost and reliable manner and without complicating its fabrication.

Specifically, the present invention relates to an electronically controlled electric fan cooled by pressurized ambient air, said electric fan comprising:

- a motor furnished with a cover, a mechanical assembly rotating a wheel and a casing, said motor housing at least its electronic control circuit and comprising at least one inlet orifice and one outlet orifice for the pressurized ambient air,
- the fan wheel,
- a motor support, said ambient air being suitable for passing through the motor, and its mechanical assembly and the support, said electric fan being characterized in that it also comprises:

- a confinement means placed inside the motor so as to confine the pressurized ambient air between:
  - a heat sink integral with the electronic control circuit, and a portion of the motor comprising no sensitive electronic components.

Thanks to such dispositions, the pressurized (possibly polluted) ambient air entering the motor is channeled into sealed, insensitive zones and allows proper cooling of the electronic control circuit without damaging the electronic components.

According to a preferred aspect of the invention, the confinement means is made by a simple molded seal. This seal is placed between the casing and the electronic circuit board, it is in contact with the heat sink (radiator) of the electronic circuit board. The seal thus creates sealed cavities between the rest of the casing and a radiator made on the face of the electronic circuit that comprises no electronic components. The cooling function with the aid of the pressurized ambient air is thus maintained in an optimum manner, since the pressurized ambient air is channeled particularly toward the radiator of the electronic control circuit. However, this ambient air (possibly charged with particles) can no longer damage the electric connections and/or the components. Specifically these components are placed on the electronic circuit board on a face which is no longer in contact with the polluted air.

Preferably the seal is made by molding or overmolding. This seal is therefore very easy to produce and install and requires no changes to the parts in place. This seal may also be a fitted seal. In this case, it is simply interposed between two existing parts (which offers the possibility of not installing it when the ambient air contains no pollution). As a result, one and the same motor may or may not be furnished with this confinement means depending on the type of ambient air in which it will be used.

Naturally, the shape of the confinement seal may be adapted to suit various motors, the essential requirement being that this confinement seal creates sealed zones for the pressurized ambient air and prevents this pressurized ambient air from gaining access to the sensitive zones (electronic components in particular).

DESCRIPTION OF THE DRAWINGS

Other objects, features and advantages of the present invention will furthermore emerge from the following description, as a nonlimiting example and with reference to the appended drawings in which.

DESCRIPTION OF THE PREFERRED EMBODIMENTS

Figure 1:
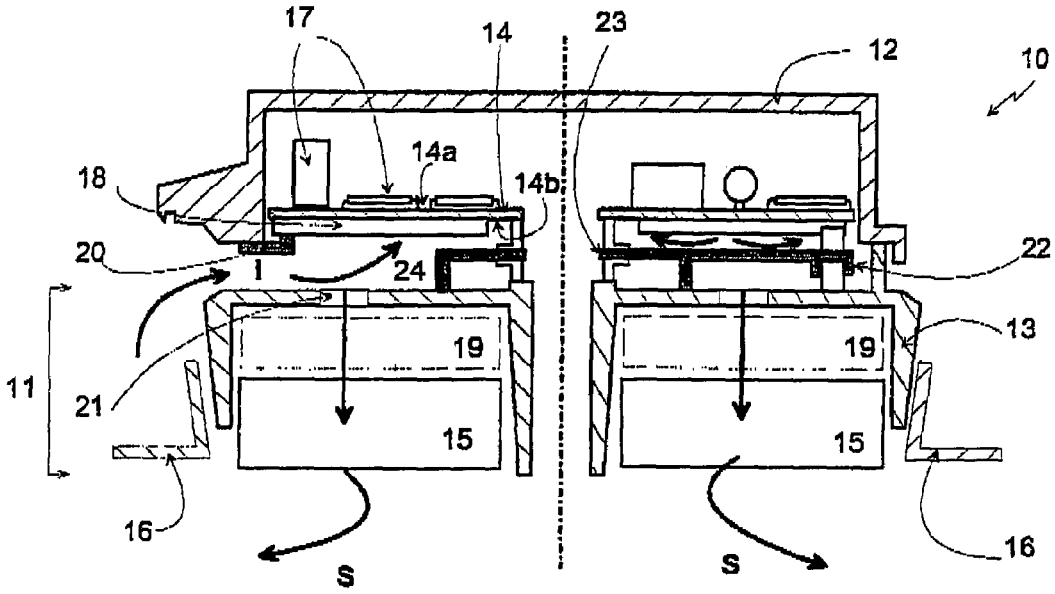
FIG. 1 is a schematic view in section of an electric fan according to the present invention.
Figure 2:
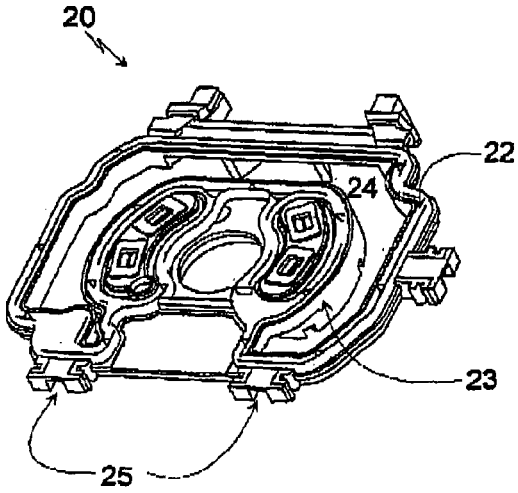
FIG. 2 is a schematic view in perspective showing a confinement seal according to the present invention.
Figure 3:
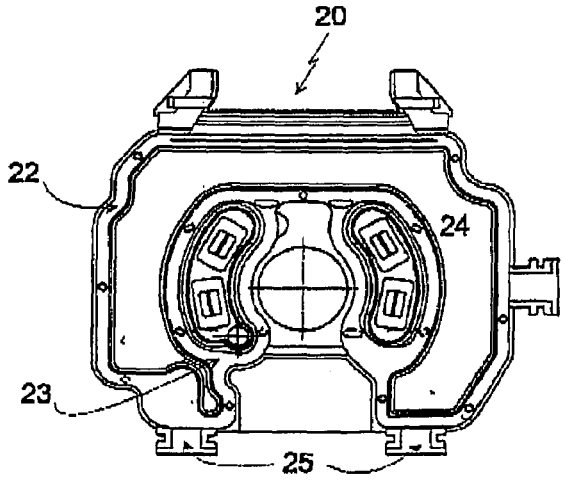
FIG. 3 is a schematic top view of a confinement seal according to the present invention.

According to the embodiment described and represented in FIGS. 1 to 3, the electric fan 10 according to the present invention comprises:

a motor 11 (FIG. 1) furnished with a cover 12 and a casing 13, said motor housing at least its electronic control circuit 14 and comprising at least one inlet orifice I and one outlet orifice S for pressurized ambient air, a fan wheel 15 and a motor support 16.

The wheel 15 and the support 16 are shown schematically in FIG. 1 because they do not constitute the core of the invention.

In the exemplary embodiment shown in FIG. 1, the electronic control circuit 14 is placed in the cover of the motor. Electronic components 17 are preferably placed on a single face of this circuit. In FIG. 1, these components are placed on the top face 14*a* of the circuit 14. The bottom face 14*b* of this circuit carries a heat sink 18 suitable for dissipating the heat created by the electronic components 17 supported by the electronic circuit 14. by the electronic circuit 14.

It is well understood that the references to the "bottom" and "top" faces are used only to simplify the description with reference to FIG. 1. Naturally, the electric fan could have other orientations.

The casing 13 of the motor comprises in particular (in the case of a "brushless" motor) in conventional manner:

a stator (armature) and a rotor (field system, coil) (shown overall by reference number 19), and a pivot assembly, bearings, etc.

All these elements are traversed by the pressurized ambient air flow.

It is already known practice to discharge the heat from the electronic circuit board via the ambient air pressurized by the fan wheel 15 through the motor (rotor, stator, mechanical elements, electronic elements).

However, this air flow enters into contact not only with the heat sink 18 (usually made of aluminum) of the electronic control circuit 14 but also with the various electronic components 17 present on the printed circuit 14. Such cooling is usually satisfactory, but when the ambient air blown over the printed circuit is polluted, the electric connections of the various components, even the components themselves, risk being damaged by the polluted air.

Thus, in a salty environment (saline maritime atmosphere) and/or an environment polluted by particles of mud, dust, snow, ice, etc, these particles get onto the printed circuit board and damage the components and/or their connections.

To overcome these disadvantages, the present invention proposes to install a confinement seal 20 between the electronic circuit 14 and the motor casing 13.

This seal has the function of channeling, in sealed manner, the pressurized ambient air in the motor solely toward the non-sensitive zones of the electronic circuit 14 in order to cool it. As shown by the arrows in FIG. 1, this air then passes through the motor (in the case shown, the air passes through the stator (armature) via the orifices 21 evenly distributed on a support of this armature) then is discharged through the outlet orifices S.

The presence of the confinement seal thus makes it possible to prevent the pressurized ambient air from gaining access to the top face 14*a* of the electronic circuit 14. This top face is specifically in a zone sealed from the pressurized ambient air (thanks to the seal 20). The electronic components present on this face therefore are no longer in contact with air that may be polluted. The risks of damage to the electronic components 17 or their connection by this polluted air are therefore removed. In addition, the confinement seal channels the pressurized ambient air toward the heat sink 18 present on the bottom face 14*b* of the electronic circuit. The cooling of this heat sink is thus better performed.

Naturally, in the case where the bottom face 14*b* of the electronic circuit 14 also supports some electronic components, the latter would be covered by the seal as protection.

As is shown in FIGS. 2 and 3, the seal 20 is an element made of plastic (for example by overmolding and as a fitted part or by depositing flexible material) comprising, at least on one portion of its periphery, a lip 22 performing a sealing function.

The seal 20 also comprises a central portion 23 preventing the ambient air from penetrating into the sensitive zones (that is to say comprising electronic components likely to be damaged by polluted air). A confinement chamber 24 (or a plurality of confinement chambers) is thus created by this seal between the bottom face 14*b* of the electronic circuit and the casing 13. It is in this sealed chamber that the air entering via the orifices I comes into contact with the heat sink 18.

As is shown in FIGS. 2 and 3, the periphery of the seal 20 may be furnished with orifices 25 for discharging water. Specifically, the polluted ambient air passing through the whole electric fan is occasionally charged with humidity. The latter could corrode the sensitive portions of the electric fan. The orifices 25 allow the stagnant humidity in the confinement chambers to be discharged toward the outside and thus protect the electric fan.

It should be noted that, depending on the shape of the casing 13, the seal 20 may have different configurations. However, there are always means for confining the pressurized ambient air between the heat sink 18 and the rest of the casing 13.

The value of such a confinement seal is also that it is detachable and therefore removable and that thus it may be removed if there is the need to gain access to the electronic components 17 for their repair. The removal of the seal 20 is a very easy operation to accomplish, without risk of damaging the electronic components.

When this seal is not detachable (in the case where the joint is overmolded, for example), it nevertheless leaves an access to the electronic components and does not in any way hamper the detachment of the electric fan.

It will also be noted that this confinement seal may (or may not) be installed depending on the use of the electric fan, without any difficulty. Thus one and the same electric fan may or may not be fitted with this seal. The production process is thereby simplified.

Naturally, the present invention is not confined to the embodiment described and shown. Thus this confinement seal could be placed between elements other than the electronic circuit board and the casing if that is used to confine the pressurized ambient air outside the sensitive zones of the motor while properly cooling the electronic circuit board.

The invention claimed is:

1. An electronically controlled electric fan (10) cooled by pressurized ambient air, said electric fan comprising:

a motor (11) furnished with a cover (12), a mechanical assembly rotating a fan wheel (15) and a casing (13), said motor housing at least its electronic control circuit (14) and comprising at least one inlet orifice (I) and one outlet orifice (S) for the pressurized ambient air, the fan wheel (15), a motor support (16), said ambient air being suitable for passing through the motor, and its mechanical assembly and the support, said electric fan being characterized in that it also comprises:

a confinement means (20) placed inside the motor so as to confine the pressurized ambient air between:

a heat sink (18) integral with the electronic control circuit (14), and a portion of the motor comprising no sensitive electronic components, wherein the confinement means is a seal, placed between the electronic control circuit (14) and the casing (13) of the motor, said seal channeling the pressurized ambient air at least onto said heat sink (18) situated on a surface of the electronic control circuit without electronic components.

2. The electric fan as claimed in claim 1, characterized in that the seal is made by overmolding the casing or by adding the seal or by depositing flexible material.

3. The electric fan as claimed in claim 1, characterized in that the seal creates a plurality of sealed cooling cavities (24) in contact with the heat sink (18) of the electronic control circuit (14).

4. The electric fan as claimed in claim 1, characterized in that the electronic control circuit (14) is placed in the cover (12) and in that the seal (20) is interposed between the electronic circuit (14) and the rest of the elements housed in the motor casing (13).

5. The electric fan as claimed in claim 1, characterized in that the seal (20) is detachable and removable in order to allow access to the electronic components.

6. The electric fan as claimed in claim 1, characterized in that the seal (20) is overmolded and allows the detachment of the electric fan and access to the electronic components.

7. The electric fan as claimed in claim 1, characterized in that said fan has at least one confinement chamber (24) allowing the pressurized ambient air to contact the heat sink (18).

8. The electric fan as claimed in claim 7, characterized in that said fan also comprises water discharge orifices (25).

9. The electric fan as claimed in claim 2, characterized in that the seal creates a plurality of sealed cooling cavities (24) in contact with the heat sink (18) of the electronic control circuit (14).

* * * * *